United States Patent [19]

Hirooka et al.

[11] Patent Number: 4,676,077

[45] Date of Patent: Jun. 30, 1987

[54] WASHING MACHINE

[75] Inventors: Hiroshi Hirooka; Takeshi Saito; Hirobumi Urabe, all of Chiba, Japan

[73] Assignee: Mitsubishi Denki Kabushiki Kaisha Nihon Kentetsu Co., Ltd., Japan

[21] Appl. No.: 831,191

[22] Filed: Feb. 20, 1986

[30] Foreign Application Priority Data

Feb. 20, 1985 [JP] Japan ..... 60/31733

[51] Int. Cl.[4] ..... D06F 33/02

[52] U.S. Cl. ..... 68/12 R; 68/133; 318/282

[58] Field of Search ..... 68/12 R, 133; 318/282, 318/434; 361/31, 33

[56] References Cited

U.S. PATENT DOCUMENTS 3,986,372 10/1976 Karklys ..... 68/12 R
4,195,500 4/1980 Tobita et al. ..... 68/12 R
4,328,522 5/1982 Tryan ..... 361/33
4,542,633 9/1985 Hirooka et al. ..... 68/133 X

FOREIGN PATENT DOCUMENTS 117165 9/1979 Japan ..... 68/12 R

*Primary Examiner*—Philip R. Coe
*Attorney, Agent, or Firm*—Sughrue, Mion, Zinn, Macpeak & Seas

[57] ABSTRACT

When it is detected that the motor for rotating the agitator of the machine is locked, the motor is turned in the forward direction and/or in the reverse direction a predetermined number of times. If the motor is still locked, an indicating unit is operated to indicate the occurrence of the abnormal condition. When the motor locked by an excessively large quantity of wash and the motor is not unlocked after the motor is turned in the opposite direction, the occurrence of the abnormal condition is indicated by an alarm unit. Therefore, the operator, informed of the presence of the abnormal condition immediately upon its occurrence, can rectify the problem, for instance, by decreasing the size of the washing load.

5 Claims, 3 Drawing Figures

WASHING MACHINE

BACKGROUND OF THE INVENTION

The present invention relates to a washing machine of a type which can automatically correct abnormal conditions which may sometimes occur.

As is well known in the art, in a washing machine the rotary blades of the agitator or pulsator are turned by an electric motor to wash clothes placed in a washing tub of the machine. The motor is usually coupled to the agitator or pulsator through an endless belt.

Sometimes the motor may be forcibly stopped by a external cause, for instance, when an excessively large load is put in the washing machine, or when foreign matter is caught between the tub and the rotary blades, or when a bearing seizes.

If a motor is maintained locked for a long period, it may burn out due to over-heating. This difficulty has heretofore been eliminated by employing a heat-sensitive fuse or a self-restoring type protective unit built into the motor so that, if the motor starts to over-heat, application of current to the motor is suspended.

However, in the case a heat-sensitive fuse is employed, it is necessary to replace the fuse with a new one each time the motor overheats, and in the case of a motor in which a self-restoring type protective unit is incorporated, it is necessary to allow the motor to cool for a long period of time before it can be restarted. Furthermore, the conventional washing machine suffers from the difficulty that the occurrence of an abnormal condition cannot be detected until the motor actually over-heats, as a result of which the motor can eventually suffer breakdown of its electrical insulation.

If the condition of rotation of the rotary blades is detected and the energization of the motor controlled according to the condition of rotation thus detected, then the occurrence of an abnormal condition within the motor can be detected before the motor overheats. Upon elimination of the abnormal condition, the operation of the washing machine can be started again.

In such a washing machine in which the condition of rotation is detected, when an abnormal condition is sensed, the motor, and accordingly the rotary blades, is turned in the opposite direction from that in which it is trying to turn. If turning the motor and the rotary blades in the opposite direction does not eliminate the abnormal condition, the motor is stopped. This method is considerably effective in preventing motor failures in a washing machine.

In a single-tank type fully automatic washing machine, the washing tank (tub) is used also as a dehydrating (spin cycle) tank, and frequently the washing operation is carried out with the lid closed. Therefore, in the case where the motor is stopped as described above, if the operator is not near the machine, it is often difficult to know that the motor has stopped because the amount of noise issuing from the machine is low under normal operating conditions.

In almost all cases where the motor is locked, the cause is an excessively large quantity of clothes put in the machine. When the motor is locked by such a large load, the motor can be readily unlocked, and therefore it is necessary to notify the operator of the locking of the motor quickly; otherwise, the operator may waste a great deal of time.

SUMMARY OF THE INVENTION

In view of the foregoing, an object of the present invention is to provide a washing machine which overcomes the above-mentioned problems of the prior art, is high in safety, and which can be readily operated.

The foregoing and other objects of the invention have been achieved by the provision of a washing machine in which, when it is detected that the motor is in a locked state, it is attempted to turn the motor in the opposite direction a predetermined number of times, and if the motor remains in the locked state after being turned in the opposite direction in this manner, an indication is provided to the operator.

According to the invention, when the motor of the washing machine is locked, for instance, by an excessive quantity of clothes put into the washing machine, the motor is turned in the opposite direction, and if the motor is maintained locked even after turning it in the opposite direction, indicating means operates to indicate the occurrence of an abnormal condition. Therefore, the operator can detect the occurrence of the abnormal condition immediately and make the washing machine operate smoothly again, for instance, by decreasing the amount of clothes in the machine.

DESCRIPTION OF THE PREFERRED EMBODIMENTS

Preferred embodiments of the invention will now be described in detail with reference to the accompanying drawings.

Figure 1:
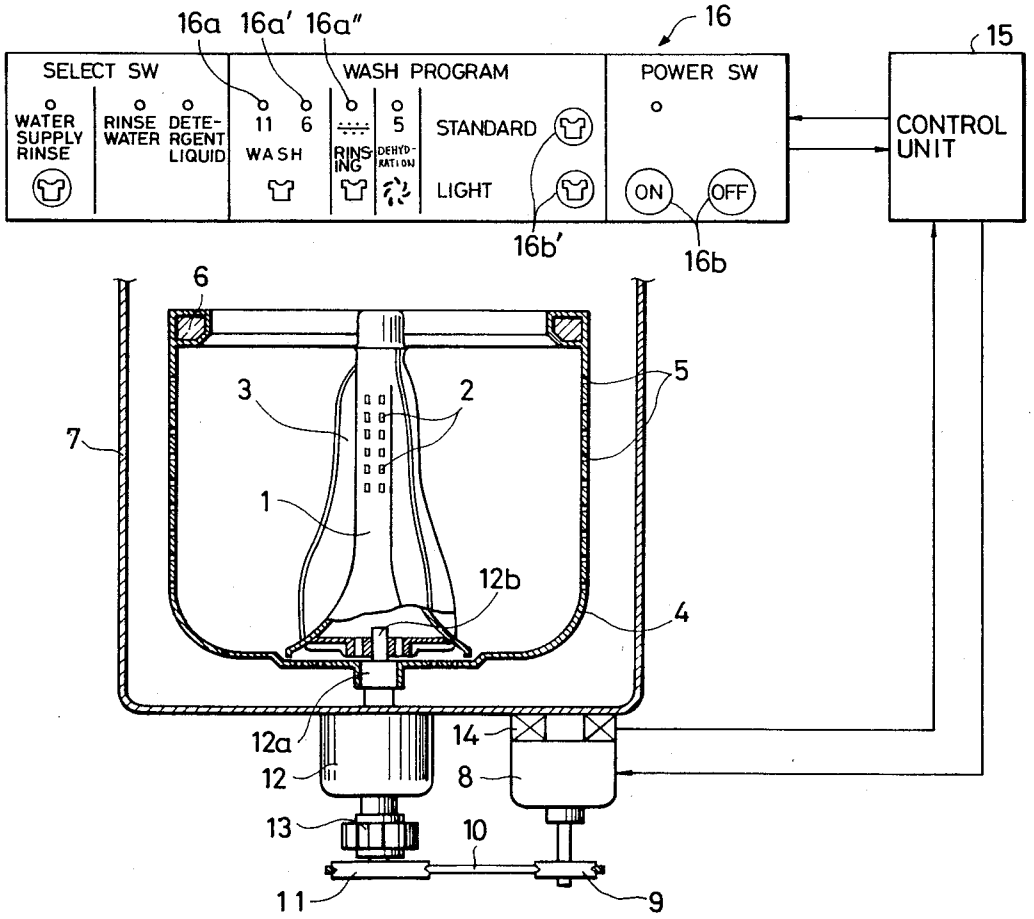
FIG. 1 is an explanatory diagram showing an example of a washing machine constructed according to this invention.

FIG. 1 is an explanatory diagram showing an example of a washing machine constructed according to the invention. In FIG. 1, reference numeral 1 designates an agitator composed of a hollow cylinder having a number of through-holes 2 in its wall and agitating blades 3 which extend vertically and radially from the wall; 4, a dehydrating tank having the agitator 1 at its center and having a side wall with a plurality of through-holes formed therein; 6, a hollow annular balancer positioned along the upper end opening of the dehydrating tank 5; and 7, a water receiving tank provided outside the dehydrating tank 4 and having a water discharging outlet (not shown) to which a drain pipe is connected.

Further in FIG. 1, reference numeral 8 designates an electric motor coupled to a rotation transmitting section 12 through a speed reducing mechanism composed of a pulley 9, an endless belt 10, and a pulley 11. The rotation transmitting section 12 has dual drive shafts **12*a* and 12*b* which are controlled by a spring clutch mechanism 13. The outer drive shaft 12*a* is coupled to the dehydrating tank 4, and the inner drive shaft 12*b* to the agitator 1**.

The motor 8 is provided with a speed detector 14 which detects the rotational speed (rpm) of the motor 8. In this embodiment, a tachometer generator may be employed as the speed detector 14.

The above-described components of the washing machine are contained within the outer case of the machine and are mounted through vibration damping members (not shown). A control unit 15, which is implemented with a microprocessor, and an operating panel 16, including operating switches 16*b*, 16*b*', etc., and indicating lamps 16*a*, 16*a*', 16*a*'', etc., are provided on the upper part of the outer case.

Both the output of the speed detector 14 and the outputs of other detectors, such as a water level detector, are applied to the control unit 15. The outputs of the control unit 15 are applied to a drive circuit for the motor 8, the lamps 16*a*, 16*b*, etc., provided on the operating panel 16, a piezoelectric buzzer, a valve control circuit for a water supplying valve and water discharging valve, and other components.

The operation of the washing machine thus constructed will be described.

During a washing operation, the clothes to be washed, water, and detergent are put in the tank 4, and the power switch is turned on. The motor 8 is then rotated alternately in the forward direction and in the reverse direction, and accordingly, the agitator 1 is rocked. In this preferred embodiment, the speed reduction ratio of the pulleys 9 and 11 is ½, and a speed reducing unit forming a part of the rotation transmitting section 12 has a speed reduction rate of 1/6. Therefore, when the motor 8 makes eight revolutions in each of the forward and reverse directions, the agitator is rocked through an angle of 240°.

If an excessively large load of clothes is put in the tank 4, or if the clothes are snagged between the agitator 1 and the tank 4, the agitator 1 will be stopped and the motor 8 locked.

In this case, the rotation detector 14 detects the locked condition of the motor, and accordingly applies an output to the control unit 15. Thereupon, the control unit 15 causes the motor 8 to turn in the opposite direction. An attempt is made to turn the motor 8 in the opposite direction several times. If, during this period, the clothes are unsnagged (or other cause of such locking is removed), the washing operation is recommenced.

If, on the other hand, the motor is turned in the opposite direction several times but remains locked, the control unit 15 provides an output to suspend the application of current to the motor 8, and further provides an output to the operating panel 16 to issue an alarm for indicating the occurrence of an abnormal condition. As a result, in the control panel 16, for instance, the lamps 16*a*, 16*a*', 16*a*'', etc., are made to flicker successively and the piezoelectric buzzer generates an alarm sound.

When the lamps flicker and the alarm sound is produced, the operator is notified that an exccessively large amount of clothes has been put in the dehydrating tank, etc., allowing the operator to correct the situation.

The above-described operations will be described in more detail.

Figure 2:
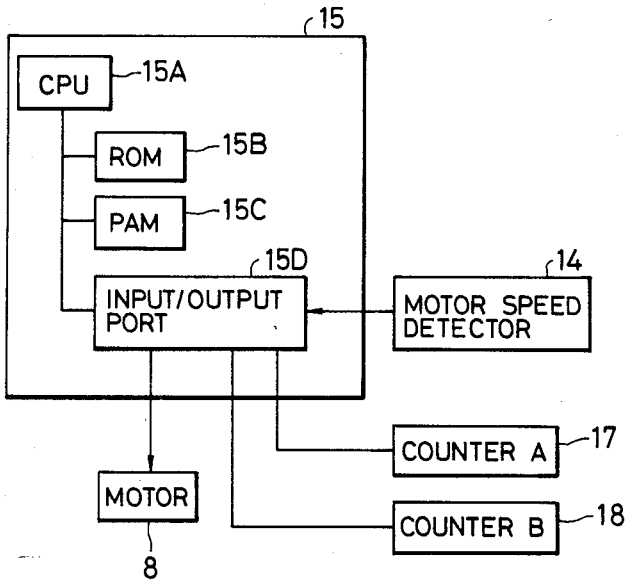
FIG. 2 is a block diagram showing a control unit in the washing machine of the invention.

As shown in FIG. 2, the control unit 15 includes a CPU (central processing unit) 15A, a ROM (read-only memory) 15B, a RAM (random-access memory) 15C, and an I/O (input/output) port 15D for inputting and outputting signals.

A counter A 17 counts how many times the motor has remained locked when the agitator is turned in the forward direction, while a counter B 18 counts how many times the motor has remained locked when the agitator 1 is turned in the reverse direction.

Figure 3:
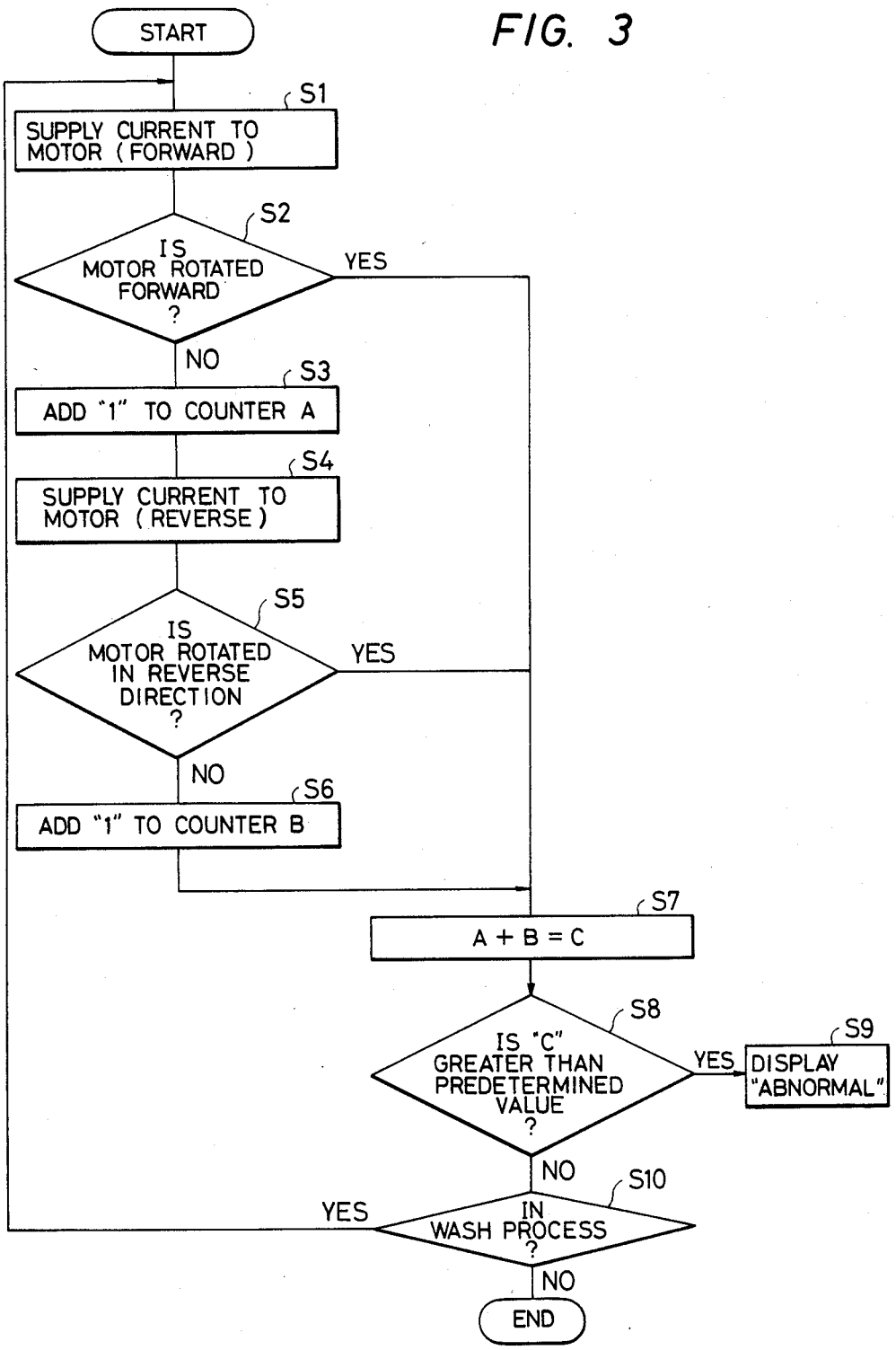
FIG. 3 is a flowchart provided for a description of the operation of the control unit.

A program as shown in FIG. 3 is stored in the ROM. The locking of the motor during the washing operation is detected according to the program thus stored.

As shown in FIG. 3, in Step S1, an energization instruction to rotate the motor 8 in the forward direction outputted by the control unit 15. In Step S2, it is determined according to the output signal of the detector 14 whether or not the motor 8 is rotating in the forward direction. If the motor 8 is not rotating in the forward direction, the control unit 15 applies a signal to the counter A so that the content of the counter A is increased by one (Step S3). In succession, the control unit 15 supplies an energization instruction to cause the motor 8 to rotate in the reverse direction (Step S4).

In Step S5, the control unit 15 determines, according to a signal similar to that in Step S2, whether or not the motor 8 is rotating in the reverse direction. When it is determined that the motor 8 is rotating in the reverse direction in Step S6, the control unit 15 applies an instruction signal to the counter B so that the count value of the latter is increased by one.

In Step 7, the control unit 15 adds the count value of the counter A to that of the counter B to obtain a sum C ($C=A+B$).

In Step S8, it is determined whether or not the value C is larger than a predetermined value. If the value C is determined to be equal to or larger than the predetermined value, it is judged that an abnormal condition has occurred, and an instruction signal is then issued to indicate the occurrence of the abnormal condition. If, on the other hand, the value C is smaller than the predetermined value, the next Step S10 is effected.

In Step S10, it is determined whether or not the washing machine is still in the normal state; that is, it is determined whether or not a predetermined washing period of time has passed. If the washing period of time has not passed yet, Step S1 is effected again. If the washing period of time has passed, the next operation is carried out.

When, in Step S2 and Step S5, it is determined that the direction of rotation of the motor 8 is acceptable, Step S7 is effected. Thereafter, the control program is executed in the same manner as described above.

As is apparent from the above description, the washing machine of the invention is designed so that, when the motor is locked such as due to an excessively large quantity of clothes being put into the machine, the motor is rotated in the opposite direction a predetermined number of times, whereafter it is attempted to operate under normal conditions. If the washing machine cannot then be operated normally, application of current to the motor is suspended to ensure the security of the washing machine, and the indicating unit is operated to indicate the occurrence of the abnormal condition. Accordingly, even if the lid of a single-tank type washing machine is closed, the operator can promptly detect when the motor is locked. Therefore, the operator can quickly deal with the trouble, for instance, by decreasing the size of the load placed in the machine.

We claim:

1. A washing machine in which a rotary blade assembly in a wash-receiving tank is rotated by an electric motor, comprising:

(a) motor locking detecting means for detecting when said motor is not turning although a motor driving instruction has been issued;

(b) reverse rotation instructing means for applying, when a signal representing the fact that said motor has been locked is received from said locking detecting means, an instruction signal to said motor to cause said motor to rotate in the opposite direction;

(c) means for detecting the fact that said reverse rotation instructing means has issued said instruction signal a predetermined number of times and to provide an output signal accordingly; and (d) means for indicating, when said number-of-times detecting means provides said output signal, the occurrence of an abnormal condition to an operator.

2. The washing machine as claimed in claim 1, wherein said locking detecting means comprises means for detecting a rotational speed of said motor.

3. The washing machine as claimed in claim 1, wherein said washing machine further comprises: an operating panel on which operating switches for controlling washing operations and indicating lamps for indicating operating conditions of said washing machine are provided, said indicating means being coupled to said indicating lamps and causing said indicating lamps to operate in a manner different from that employed when said washing machine is operated under normal conditions to indicate the occurrence of an abnormal condition in said washing machine.

4. The washing machine as claimed in claim 3, wherein said indicating means comprises means for causing at least some of said indicating lamps to flicker in a predetermined order to indicate the occurrence of an abnormal condition in said washing machine.

5. The washing machine as claimed in claim 1, wherein said motor locking detecting means comprises means for detecting when a locking condition of said motor is eliminated by turning said motor in an opposite direction, and wherein said washing machine further comprises: returning means for causing, upon provision of a signal from said locking detecting means representing the fact that the locking condition of said motor has been eliminated, said motor to operate beginning from a start of a washing operation in which said motor was locked.

* * * * *